United States Patent [19]
Locker
[11] 4,293,407
[45] Oct. 6, 1981

[54] SIEVE DEVICE FOR SEPARATING A MIXTURE OF PARTICULATE MATERIAL IN COMPONENTS OF DIFFERENT SIZES

[75] Inventor: Jan A. K. Locker, Steenwijk, Netherlands

[73] Assignees: Machinefabriek A. Wijnveen B.V., Ede; Cooperatieve Landbouw aan- en verkoopcombinatie, B.A. "C.L.C.", Steenwijk, both of Netherlands

[21] Appl. No.: 196,089

[22] Filed: Oct. 10, 1980

[30] Foreign Application Priority Data

Oct. 12, 1979 [NL] Netherlands ..... 7907587

[51] Int. Cl.[3] ..... B07B 1/08

[52] U.S. Cl. ..... 209/253; 209/254; 209/279

[58] Field of Search ..... 209/253, 254, 274, 279, 209/280, 315, 350, 351

[56] References Cited

U.S. PATENT DOCUMENTS

| | | | |
|---|---|---|---|
| 755,330 | 3/1904 | Sturtevant et al. | 209/347 |
| 772,860 | 10/1904 | Bemis | 209/315 X |
| 1,173,671 | 2/1916 | McKinlay | 209/350 X |
| 3,416,660 | 12/1968 | Larsson | 209/254 |

FOREIGN PATENT DOCUMENTS

| | | | |
|---|---|---|---|
| 440697 | 2/1927 | Fed. Rep. of Germany . | |
| 1417522 | 10/1965 | France . | |
| 2407026 | 5/1979 | France . | |
| 3375 | of 1892 | United Kingdom . | |
| 275720 | 10/1970 | U.S.S.R. | 209/315 |

*Primary Examiner*—Ralph J. Hill
*Attorney, Agent, or Firm*—Andrus, Sceales, Starke & Sawall

[57] ABSTRACT

A sieve device for separating a mixture of particulate material in components of different sizes, comprising a perforated sieve surface that rotates around a central, vertical shaft, said sieve surface having the shape of a hollow, truncated cone casing with a downwardly directed top, on which an imperforate distributor cone with an upwardly directed top has been mounted in the middle, of which distributor cone the base connects to the sieve surface, whereas the supply of the mixture to be separated takes place via a central supply tube placed above the distributor cone, whereas the removal of the coarse component takes place near the circumference of the sieve surface.

The novel device comprises at least one additional sieve surface, of which the diameter of the perforations differs from that of the former sieve surface, which additional sieve surface is displaceable between a non operative position, in which it is removed from the former sieve surface and cannot receive mixture, and an operative position, in which it is placed on top of the former sieve surface and can receive the supply of mixture.

15 Claims, 4 Drawing Figures

SIEVE DEVICE FOR SEPARATING A MIXTURE OF PARTICULATE MATERIAL IN COMPONENTS OF DIFFERENT SIZES

BACKGROUND OF THE INVENTION

The invention relates to a sieve device for separating a mixture of particulate material in components of different sizes, comprising a perforated sieve surface that rotates around a central, vertical shaft, said shieve surface having the shape of a hollow, truncated cone casing with a downwardly directed top, on which an imperforate distributor cone with an upwardly directed top has been mounted in the middle, of which distributor cone the base connects to the sieve surface, whereas the supply of the mixture to be separated takes place via a central supply tube placed above the distributor cone, whereas the removal of the coarse component takes place near the circumference of the sieve surface.

A sieve device of this type is known from the Netherlands patent specification No. 7605572 laid open to public inspection. Although this device has a fast, good and dependable operation, and is especially adapted for the separation of coarse press pellets of animal fodder from the grits that have formed therefrom, the size of the passage openings of the sieve surface is constant, whereby the processing of press pellets of different sizes on the same sieve device is impossible.

SUMMARY OF THE INVENTION

The object of the invention is obviating this objection and providing a sieve device, with which it is possible to separate with one single sieve device the coarse components of differet sizes from one or more fine components.

This object is reached according to the invention, in that at least one additional sieve surface is arranged, of which the diameter of the perforations differs from those of the former sieve surface, which additional sieve surface can be displaced between a non-operative position, in which it is removed from the former sieve surface and cannot receive any mixture, and an operative position, in which it is mounted on top of the former sieve surface and receives the supply of mixture.

By the application of the invention it it reached, that in the operative position of the additional sieve surface another size of perforation is presented to the mixture to be separated, whereby this can sieve off components of different particle size.

Accordig to a preferred embodiment of the invention the diameter of the perforations of the additional sieve surface is smaller than that of the lower sieve surface. This has as a consequence, that a fraction can be sieved off having a smallest particle size that is smaller than that with the lower most sieve surface.

According to another preferred embodiment of the invention the additional sieve surface can be displaced with a rectilinear, vertical movement between the non-operative and the operative position. This gives a smaller construction height of the sieve device, whereas also the other dimensions can be reduced.

DESCRIPTION OF THE DRAWINGS

The invention will now be elucidated with reference to the accompanying drawing of some embodiments given as examples.

DESCRIPTION OF THE ILLUSTRATED EMBODIMENT

Figure 1:
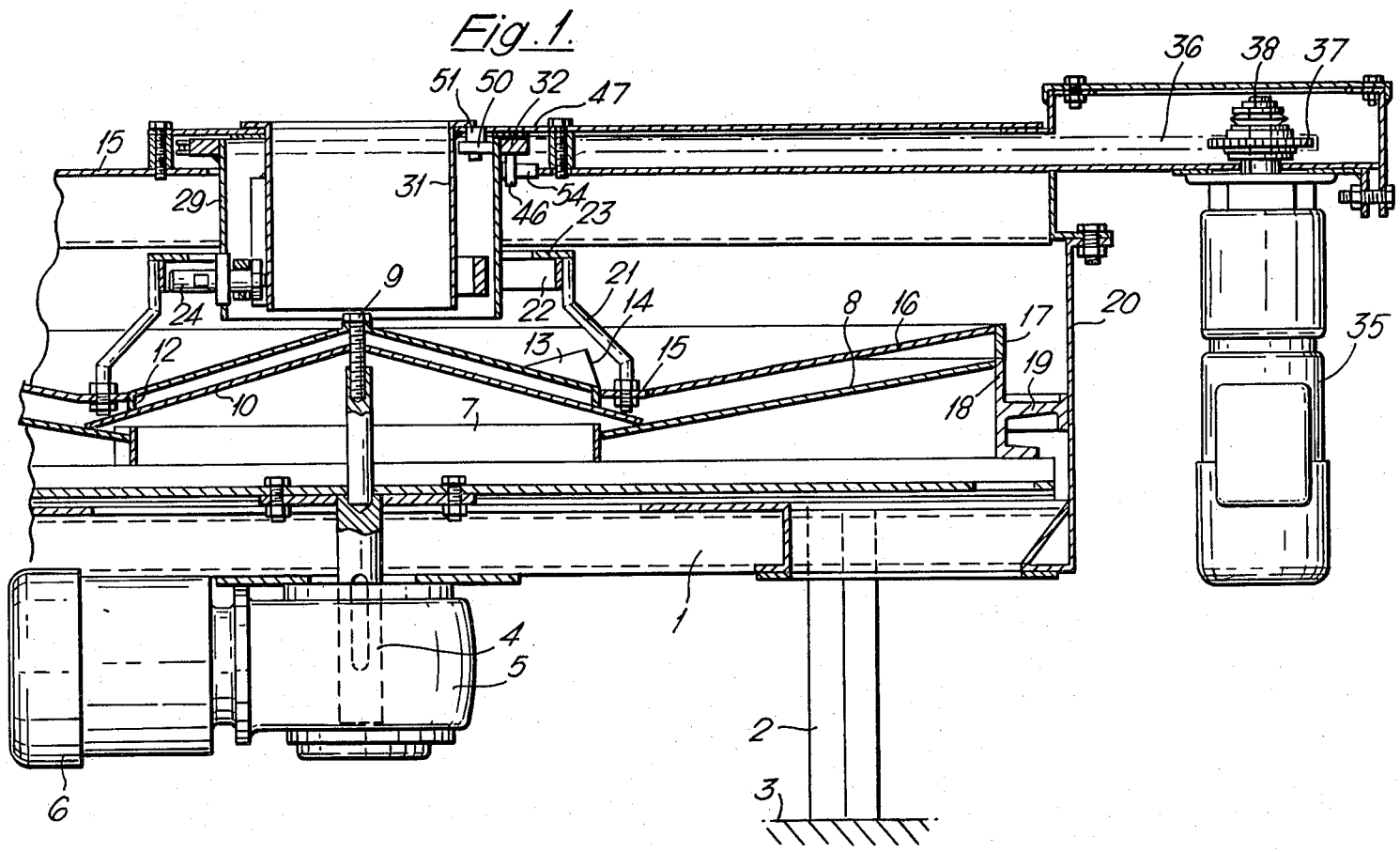
FIG. 1 shows a side view in axial cross section of a sieve device according to the invention in the operative position.
Figures 2, 3:
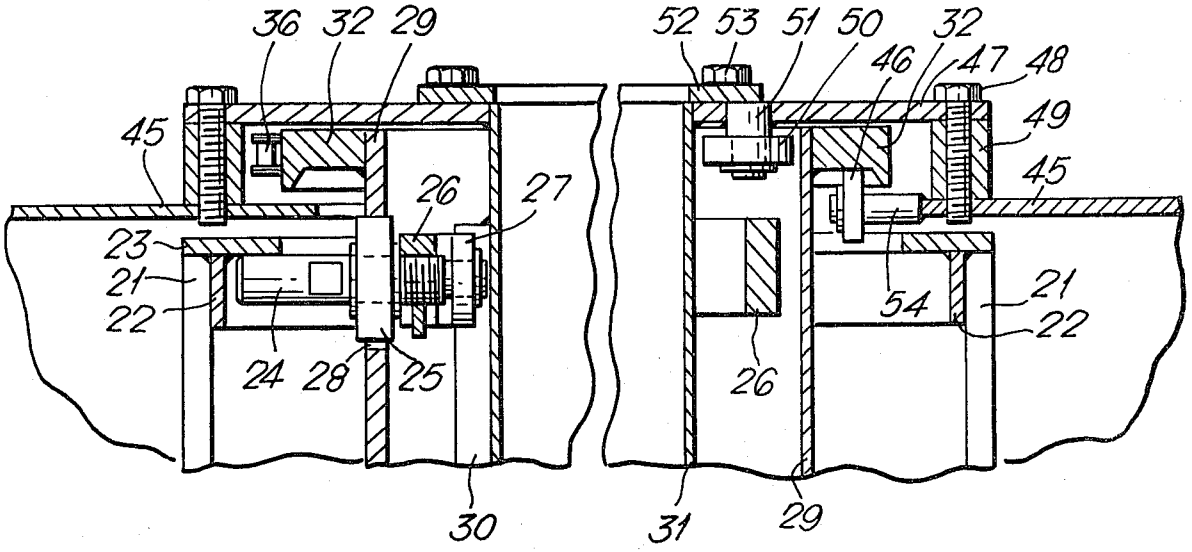
FIGS. 2 and 3 show on an enlarged scale details of the lift device applied in the device according to FIG. 1.
Figure 4:
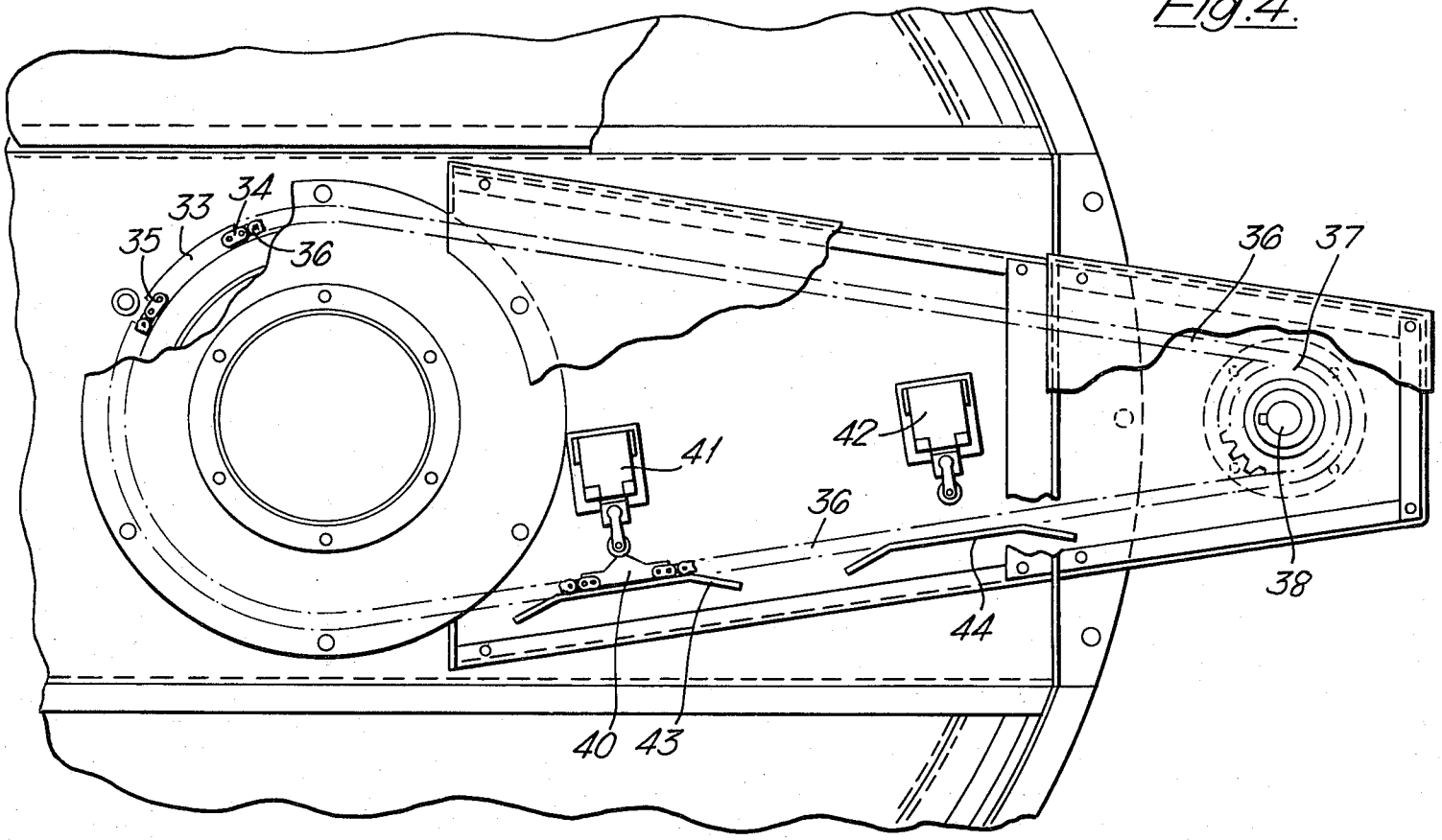
FIG. 4 is a plan view of the device according to FIG. 1, showing the control of the drive for the lift device.

The sieve device shown in FIGS. 1 through 4 comprises a frame, that is constructed from a number of horizontal beams 1, which rest by means of a number of horizontal beams 1, which rest by means of a number of legs 2 on the ground 3.

In the middle of the frame 1 a central drive shaft 4 is arranged, which is coupled on the lower side of the beams 1 with a gear box 5 that is suspended to the frame, on which gear box 5 an electrical drive motor 6 is connected. To the upper side of the central shaft 4, having a smaller diameter than the lower side, the main sieve surface 8 is fastened by means of a wheel 7. This main sieve surface 8 is in the shape of a truncated, hollow cone casing, of which the top is downwardly directed. The angle of inclination of the main sieve surface 8 with the horizontal is relatively small and can amount to about 10° to 20°. The perforations of the sieve surface 8 have in the shown embodiment a size of 7 to 8 mm, whereas those of the additional or auxiliary sieve surface 16 have a size of 4 to 5 mm.

On the central shaft 4 a composite, non perforate distributor cone 10 has been fastened by means of a central screw bolt 9, which distributor cone has the top angle upwardly directed. This cone 10 connects with its circumferential edge to the lower or main sieve surface 8, whereas the vertically displacable, upper sieve 16 connects in the operative position to the higher placed part of the cone 10.

The distributor cone 10 has been further provided around the outer circumference thereof with a number of spaced, triangular guide elements 13, which are welded with one side to the composite distributor cone 10, whereas the outwardly directed triangle side 14 makes a small angle with the vertical and acts as a guide means for the inner edge of a ring shaped plate 15.

This ring shaped, horizontal plate 15 has been fastened on the inside of the additional or auxiliary sieve surface 16 that extends parallel to the main sieve surface 8 and can rest with a cylindrical vertical circumferential edge 17 on the outer circumference of the main sieve surface 8, which can move itself with a small play over the support and sealing 18, which is fastened with a horizontal ring 19 to the outer wall 20 of the housing of the sieve device.

Through the ring shaped plate 15 the lower end is fastened of a number of Z shaped support rods 21 spaced around the circumference, of which rods the upper end is suspended to a cylindrical support bushing 22 with a ring shaped, horizontally protruding upper flange 23.

The cylindrical support bushing 22 with the horizontally protruding upper flange 23 rests on the upper end of a number of support shafts 24 spaced around the inner circumference thereof. These support shafts 24 each carry—viewed in an inward direction—a rotatable lift roll 25 and are then rotatably fastened in a spacer ring 26 and carry at last at the inner end a rotatable guide roll 27.

The lift rolls 25 are each displacable in a corresponding, helically shaped slit 28 in a cylindrical lift bushing 29, which is vertically mounted and can be driven with a reciprocating rotational movement for lifting and lowering respectively of the cylindrical support bushing 22 with the support rods 21, the ring shaped support plate 15 and the additional sieve surface 16 between the non operative and the operative position.

The guide rolls 27, that are rotatably fastened to the inner ends of the support shafts 24, are each locked in between two vertical guide strips 30 that have been fastened to the outside of the supply tube 31. The rotating, reciprocating movement of the lift bushing 29 is obtained via a horizontally and outwardly protruding flange 32. At the outside of the lift bushing flange 32 a catch strip 33 is fastened, which is at both ends 34, 35 coupled with one end of a chain 36 which is stretched around a chain sprocket 37, that is fastened on a driven shaft 38 of an electrical motor 39 which is rotatable in two directions, that is suspended next to the housing 20.

In a straight part of the drive chain 36 an operating boss 40 is mounted, for the alternative operation of two corresponding end switches 41, 42 which are fixedly arranged with a spacing along the track of the chain 36. These end switches are adapted for switching off the motor 39 at the end of the lift and lower movement respectively of the additional sieve surface 16 when reaching the non-operative and the operative position respectively of the additional sieve surface 16. At the other side of the track of the chain 36 opposite the end switches 41 and 42 a pair of guide plates 43, 44 are fastened, which ensure that the operation of the switches always takes place when the operating boss 40 arrives at the guide plates.

The lift device further comprises a number of support and guide rolls 46 that are spaced around the circumference of the lift bushing 29 and are fastened to the upper wall 45 of the device. These rolls 46 support the lower side of the outwardly extending upper flange 32 of the lift bushing 29. The support and guide rolls 46 have horizontal rotation shafts 54.

Furthermore the upper lid 47 of the sieve device, that is fastened on the upper wall of the device by means of screw bolts 48 and a spacer ring 49, comprises a number of positioning and guide rolls 50 that are spaced around the circumference. These positioning and guide rolls 50 contact the inner side of the lift bushing 29, at the level of the outwardly protruding upper flange 32.

The guide rolls 50 are rotatable around the vertical shafts 51, that are fastened in the upper lid 47 and are fixed by means of a closing ring 52 with a series of screw bolts 53. The horizontal rotation shafts 54 of the support rolls 46 extend substantially in the extension of the upper wall 45 of the device.

The invention is not limited to the shown and or described embodiments but covers all variations thereof.

The embodiments of the invention in which an exclusive property or privilege is claimed are defined as follows:

1. Sieve device for separating a mixture of particulate material in components of different sizes, comprising a perforated sieve surface that rotates around a central, vertical shaft, said sieve surface having the shape of a hollow, truncated cone casing with a downwardly directed apex, on which an imperforate distributor cone with an upwardly directed apex has been mounted in the middle, of which distributor cone the base connects to the sieve surface, whereas the supply of the mixture to be separated takes place via a central supply tube placed above the distributor cone, whereas the removal of the coarse component takes place near the circumference of the sieve surface, wherein at least one additional sieve surface of which the diameter of the perforations differs from that of the former sieve surface, which additional sieve surface is displacable between a non-operative position, in which it is removed from the former sieve surface and cannot receive mixture, and an operative position, in which it is placed on top of the former sieve surface and receives the supply of mixture.

2. Device according to claim 1, wherein the diameter of the perforations of the additional sieve surface is smaller than that of the lower most sieve surface.

3. Device according to claim 1, wherein the additional sieve surface is displacable with a rectilinear vertical movement between the non-operative and the operative position.

4. Device according to claim 1, wherein the additional sieve surface is suspended on a carrier, which is displacable by means of a displacement mechanism between the non-operative and the operative position.

5. Device according to claim 4, wherein the carrier comprises a ring shaped plate of which the outer wall is fastened to the additional sieve surface and the inner wall is in the operative position with play displacable around the cylindrical casing surface of the composite distributor cone, which is fastened on apex of the lower most distributor cone and has substantially the same top angle.

6. Device according to claim 5, wherein the ring shaped plate of the carrier is suspended by means of a number of circumferentially spaced support rods to a cylindrical support bushing with a ring shaped, horizontally protruding upper flange.

7. Device according to claim 6, wherein support and guide rolls having horizontal rotation axis are mounted at the upper wall of the device, said rolls supporting the lower side of the outwardly protruding upper flange of the support bushing.

8. Device according to claim 1, wherein the composite distributor cone is provided on the upper side with a number of circumferentially spaced, triangular guide elements, of which the guide plane protruding above the cone surface increases from a smaller diameter to the diameter of the cylindrical casing surface, so that the additional sieve surface is guidingly moved into the operative position.

9. Device according to claim 1, wherein the cylindrical support bushing rests with its horizontally protruding upper flange on the outer end of a number of support shafts spaced around the inner circumference of the flange, which support shafts considered in an inward direction each first carry a rotatable lift roll, are furthermore unrotatably fastened in a spacer ring and carry at last at the inner end a rotatable guide roll.

10. Device according to claim 9, wherein the guide rolls are each displacable in a corresponding, helical slit in a cylindrical lift bushing, which is vertically mounted and can be driven with a reciprocating rotational movement for lifting and lowering respectively of the cylindrical support bushing together with the support rods, the ring shaped support plate and the additional sieve surface between the non-operative and the operative position.

11. Device according to claim 10, wherein the lift bushing has a horizontally and outwardly protruding flange for the rotating, reciprocating drive of the lift bushing.

12. Device according to claim 11, wherein at the outside of the lift bushing flange a catch strip is fastened which is coupled at both ends to one end of a chain which is stretched around a chain sprocket, that is fastened on a driven shaft of an electrical motor which is rotatable in two directions.

13. Device according to claim 12, wherein an operating boss is mounted in a straight part of the drive chain for the alternative operation of two corresponding end switches, that are fixably mounted with a spacing along the track of the chain and are adapted for switching off the motor at the end of the lift and lower movement respectively of the corresponding sieve surface when reaching the non-operative and the operative positon respectively of the additional sieve surface.

14. Device according to claim 10, wherein a number of positioning and guide rolls are mounted at the upper lid of the upper wall of the device and are spaced around the circumference of said lid, said rolls contacting the inner side of the lift bushing of the outwardly protruding upper flange.

15. Device according to claim 9, wherein the guide rolls, which are rotatably fastened to the inner ends of the support shafts, are each locked up between two guide strips that are fastened to the outside of the supply bushing.

* * * * *